US005161594A

United States Patent [19]

Bolton et al.

[11] Patent Number: 5,161,594

[45] Date of Patent: Nov. 10, 1992

[54] TIE BAR MONITORING SYSTEM

[75] Inventors: Darryl A. Bolton, Bristol; Jesse R. Meisterling, East Hampton, both of Conn.; William Ormond, Hamilton; Gordon H. Woodhouse, St. Catharines, both of Canada

[73] Assignee: Raymond Engineering Inc., Middletown, Conn.

[21] Appl. No.: 288,431

[22] Filed: Dec. 21, 1988

[51] Int. Cl.[5] ..... B22D 17/26; B22D 17/32

[52] U.S. Cl. ..... 164/4.1; 164/150; 164/312; 73/761; 73/862.54

[58] Field of Search ..... 164/4.1, 150, 154, 312, 164/342; 73/597, 761, 849, 862.54; 425/589

[56] References Cited

U.S. PATENT DOCUMENTS

| | | | |
|---|---|---|---|
| Re. 32,048 | 12/1985 | Prince | 164/154 |
| 4,256,166 | 3/1981 | Prince | 164/154 |
| 4,367,655 | 1/1983 | Bluml et al. | 73/862.54 |
| 4,413,517 | 11/1983 | Soden | 73/597 |
| 4,429,579 | 2/1984 | Wilhelm | 73/761 |
| 4,466,477 | 8/1984 | Alofs | 164/150 |
| 4,471,657 | 9/1984 | Voris et al. | 73/597 |
| 4,569,229 | 2/1986 | de Halleux | 73/597 |
| 4,598,758 | 7/1986 | Nyland et al. | 164/154 |
| 4,602,511 | 7/1986 | Holt | 73/597 |
| 4,716,952 | 1/1988 | Hegel et al. | 164/150 |

FOREIGN PATENT DOCUMENTS

| | | | |
|---|---|---|---|
| 37257 | 2/1985 | Japan | 164/4.1 |
| 1359732 | 12/1987 | U.S.S.R. | 73/597 |

*Primary Examiner*—Richard K. Seidel

*Attorney, Agent, or Firm*—Fishman, Dionne & Cantor

[57] ABSTRACT

A system is presented for monitoring, measuring and controlling tie bars in, for example, a die casting machine. In this system, an ultrasonic device is used to monitor stress, strain, load, bending and temperature changes in each of the tie bars (typically four). This ultrasonic system will sound an alarm and/or shut down the die cast machine if bending in individual tie bars exceeds a predetermined limit, or if the variance in the combined tie bar loads exceeds a predetermined critical limit. The system of the present invention is comprised of an ultrasonic device that monitors changes in tie bar length with applied load, transducers that send and receive the ultrasonic signals to and from the tie bars, a microprocessor to select the proper transducer and log the data, and a multiplexer that switches the transducer signals on command from the controlling microprocesor. Preferably, the tie bars are instrumented with four equally spaced transducers. Also in a preferred embodiment, the four equally spaced transducers are positioned such that one transducer is in each quadrant and each transducer is mounted on the radius of the tie bar, between the center and the outer edge.

54 Claims, 1 Drawing Sheet

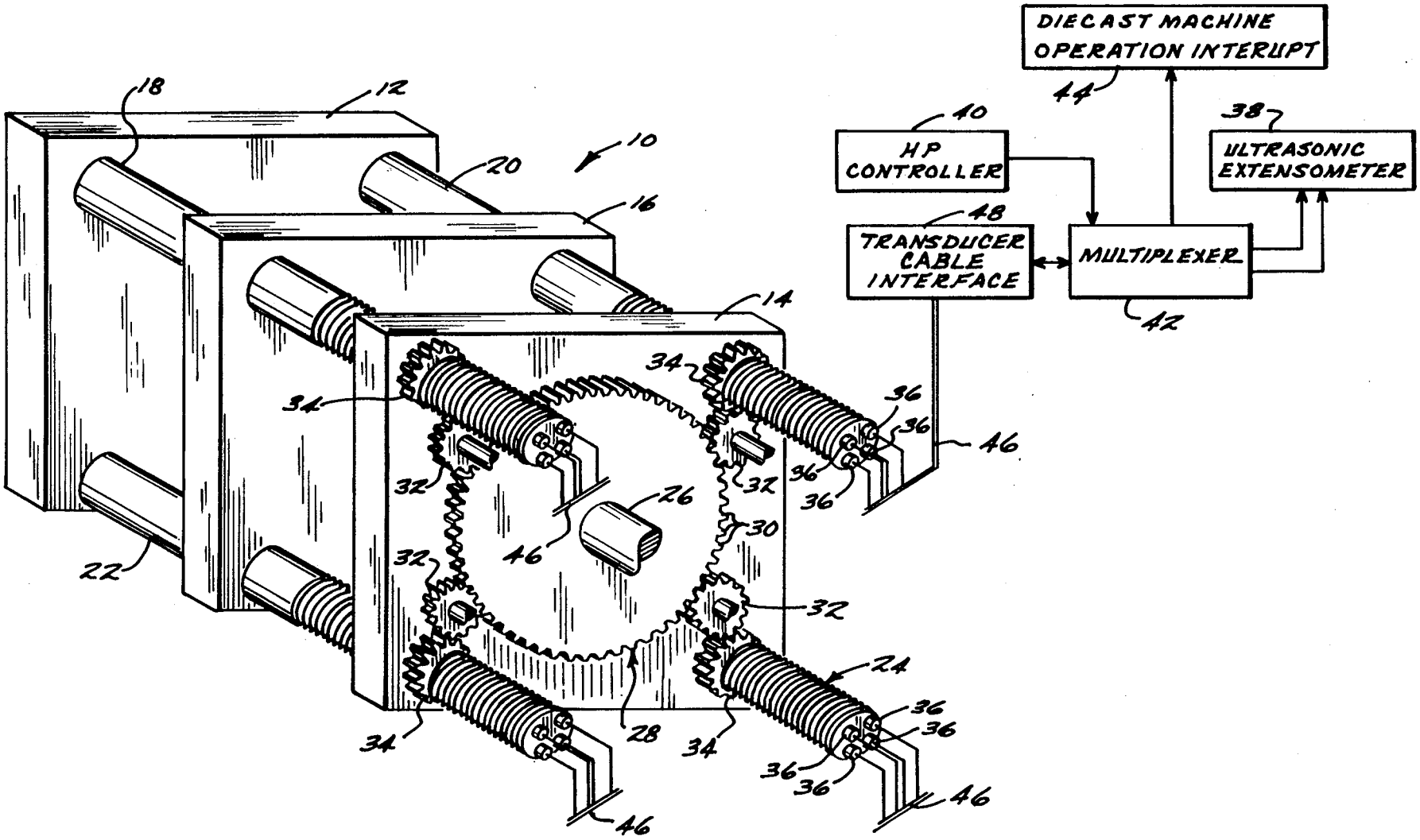
DIECAST MACHINE OPERATION INTERUPT
44
ULTRASONIC EXTENSOMETER
38
MULTIPLEXER
42
H.P. CONTROLLER
40
TRANSDUCER CABLE INTERFACE
48
46
36
36
36
36
36
36
24
32
30
32
14
34
34
34
34
26
28
46
46
10
16
20
12
18
22

TIE BAR MONITORING SYSTEM

BACKGROUND OF THE INVENTION

This invention relates generally to an ultrasonic device to monitor, measure and control tie bar stresses and strain in machines that use tie bars as a basic part of the design of the machine, such as die casting machines, injection molding machines, and all other machines that use tie bars.

In this device, an ultrasonic system is used to measure stress and strain in the bars, due to tension, bending, or stress imparted to the bars or stresses caused by temperature changes within the die, the platens, or the bars themselves.

This ultrasonic detection system produces an electrical signal, the output of which can be used to automatically adjust an individual tie bar for strains, or in the case of an overload, to sound an alarm, and/or shut down the machine.

Large die casting machines such as those used in the manufacture of aluminum automotive drive train components use a plurality of very large threaded tie bars on which one half of a precision die slides to allow the die halves to open and close during each casting cycle. It will be appreciated that the precision die must be evenly loaded during a casting cycle to insure proper formation and dimensional accuracy of the part being cast and to prevent molten metal from leaking into the seam between the die halves. Once solidified, this metal becomes "flash". Accordingly, in such die casting machines which frequently operate on an almost continuous basis during operation, it is important that the tie bar tension from bar to bar remain within preselected limits to maintain part quality and to prevent tie bar failure from uneven loads, and to prevent excessive wear on dies and the machine itself.

During operation of these machines, even if the initial tie bar tension is accurately provided for the desired operation of the machine, the tension in the several tie bars will subsequently vary. This variation is due largely to the thermal effect of the material introduced into the die. This heating effect can cause the preselected tensile forces on the several tie bars to change dramatically resulting in uneven closing of the die; and it may result in undesirable forces on closing of the die halves. Of course, all of these events can lead to defective product, broken tie bars, and/or cracked dies. In addition, the flash can become coined into the die face, which shortens the die life.

Even a small amount of flash build-up can cause uneven tie bar and die face loading. As the machine cycles, the uneven loading will fatigue the tie bars and warp the die. This can be extremely expensive since a replacement die can incur costs of about $750,000 and a replacement tie bar can cost about $20,000. In addition, other repair costs associated with damage caused by uneven tie bar and die face loading include lost revenue from down time and labor costs incurred during repairs.

Typically, with most tie bar machines, it has been necessary to frequently manually and individually adjust each of the tie bars during operation to assure that the product quality remains relatively constant with changing temperatures, and that tension on the tie bars of the machine remain even. Of course, such adjusting will shut down operation of the machinery and is costly in terms of lost production.

Monitoring systems for conventional tie bar machines are in use, but unfortunately all suffer from certain drawbacks and disadvantages. For example, one method involves connecting strain gauges with associated analog dial readouts to each of the tie bars. However, this system is inadequate because the response time of the analog readouts and the inability to track bending in the tie bars can result in premature failure of the tie bars and/or die. An example of a tie bar monitoring system employing strain gauges associated with an electrical circuit for detecting and controlling tie bar tension is described in U.S. Pat. No. 4,256,166, the entire disclosure of which is incorporated herein by reference.

Still another system for monitoring tie bar tension is disclosed in a paper entitled "The Locking End - Tie Bar Adjustments" by Barry Upton, published in Die Casting Management, Nov.-Dec. 1986, pages 18-22. This system utilizes a plurality of linear variable displacement transformer (LVDT) devices. However, the LVDT system is also inadequate because of the delicate mechanical mechanisms required to implement this system and the difficulty in retrofitting existing machines with this type of tie bar monitoring equipment.

SUMMARY OF THE INVENTION

The above-discussed and other problems and deficiencies of the prior art are overcome or alleviated by the system of the present invention for monitoring and adjusting tie bars in such machines including die casting machines. In accordance with the present invention, an ultrasonic system employing multiple transducers for each tie bar is used to monitor stress and strain due to load, bending and temperature changes in each of the tie bars. The signal from this ultrasonic system can be used to adjust the tie bar load, or sound an alarm and/or shut down the machine if bending in individual tie bars exceeds a predetermined limit, or if the load on any one tie bar exceeds, or falls below, a predetermined critical limit.

The tie bar monitoring system of the present invention is comprised of an ultrasonic device that monitors changes in tie bar length with applied load, transducers that send and receive the ultrasonic signals from the tie bar, a microprocessor to select the proper transducer and log the data, and a multiplexer that switches the transducer signals on command from the controlling microprocessor. To obtain bending measurement, the tie bars are preferably instrumented with four equally spaced transducers. Also in a preferred embodiment, the four equally spaced transducers are positioned such that one transducer is in each quadrant; and each transducer is mounted between the center and the peripheral area of the tie bar.

The present invention will monitor both loading on a single tie bar as well as loading between all of the tie bars. On start-up of the system, the initial length readings for each transducer on each bar are taken and logged in by the computer. As the tie bars are loaded, the computer ultrasonically monitors the change in length seen by each transducer. If bending occurs in a tie bar, the variance of the four averaged readings of the transducers on one tie bar at any one time may exceed the acceptable limit. The system will then adjust the load, alert the operator and/or shut down the machine.

Also, an averaged reading for each individual bar will be measured and compared to the other averaged bar readings. The variance of these readings equates to uneven loading on the die face. If this loading exceeds a predetermined variance, the computer will again adjust the load, and/or shut the system down. This process is repeated for each cycle of the machine.

It will be appreciated that any change in the initial load of the tie bars during the continued operation of the machine may be due to thermal conditions or flash in the die. Thus, differential heating conditions can be monitored by the present invention; as well as changes in the overall initial load lengths of the four tie bars. In addition, thermally induced loading variances can be tracked during the operation of the machine. Also, dynamic loads (resulting, e.g. from the injected material into the mold) can be monitored.

Still another feature of the ultrasonic system of the present invention is that of continuous monitoring for cracks in each tie bar. A crack in a tie bar at an intermediate position will result in a drastic change in the ultrasonic reading. If a crack is sensed by a transducer, the system can be shut down and/or the operator alerted.

BRIEF DESCRIPTION OF THE DRAWINGS

In order that the invention and its advantages may be more readily understood by those of ordinary skill in the art, one embodiment thereof will now be described in detail, by way of example only, with reference to the accompanying drawings.

The single FIGURE of the drawings is a schematic perspective view of a die casting machine employing the ultrasonic tie bar monitoring system of the present invention.

DESCRIPTION OF THE PREFERRED EMBODIMENT

Referring to the single FIGURE, a die casting machine is shown generally at 10 incorporating the tie bar load monitoring system of the present invention. Die casting machine 10 includes a front stationary plate 12, a rear stationary plate 14, and a movable plate 16 positioned between the front and rear plates and movable therebetween. On the rearward facing surface of front plate 12, there is attached one half of a die (not shown) while the corresponding mating half of the die is mounted on the front surface of movable plate 16. Plate 16 is slidably mounted on unthreaded sections of four spaced threaded tie bars 18, 20, 22, and 24. Plate 12 is secured to one end of each of the tie bars 18, 20, 22, 24. Plate 14 is movable relative to the tie bars and reacts against geared nuts 34 threaded onto the tie bars, whereby the reaction force of the die casting operation is transmitted to the tie bars through nuts 34.

Die casting machine 10 also includes a hydraulic ram (not shown) coupled between rear plate 14 and a toggle linkage (not shown) extending between rear plate 14 and movable plate 16 for advancing movable plate 16 into a locked up casting position with the die halves closed and for retracting movable plate 16 away from plate 12 opening the die for removal of the cast part. Die casting machine 10 has a generally well known construction and is of the same general type as that disclosed in U.S. Pat. No. 3,407,685, the entire disclosure of which is incorporated herein by reference.

Mounted to the rear surface of rear plate 14 for rotation in a conventional fashion by means of an axle 26 is a bull gear 28 having outwardly extending peripheral teeth 30. Teeth 30 of centrally located bull gear 28 engage longitudinally movable idler gears 32, one each associated with one of the four tie bars. Gears 32 in turn selectively engage adjustment nuts 34 which are associated with and threaded onto each of the tie bars such that when bull gear 28 rotates and an idler gear 32 is engaged with the associated adjustment nut 34, the tie bar lockup tension will be changed by rotation of the bull gear. The tension adjustment to the tie bars is accomplished during the die open position of operation while the result of the adjustment is monitored during lockup.

In accordance with an essential feature of the present invention, ultrasonic transducers are utilized for monitoring the load on the four tie bars 18, 20, 22 and 24. The technology, including apparatus and methods, of ultrasonically measuring the elongation of bolts to determine load or tightening of the bolt is well known. Apparatus and methods of varying degrees of sophistication are shown, for example in U.S. Pat. Nos. 3,759,090, 3,810,385, 3,969,810, 4,413,518 and 4,471,651 (this list of prior art patents being intended merely as a sampling and not intended to be a comprehensive listing of prior art patents in the field). Regardless of the level of sophistication of the technology described in these patents, it all uses an ultrasonic transducer in contact with a bolt whose load induced elongation is to be ultrasonically measured. In response to electronic input pulses, the transducer sends an ultrasonic pulse along the length of the bolt, senses the echo from the end of the bolt, and delivers a measurement signal to the measuring and detecting circuitry of the apparatus to determine the change in length of the bolt relative to an unloaded measurement. It is to be noted that these prior art systems use only one transducer in a bolt and are concerned only with measurement of changes in length of one bolt to determine the load on that bolt.

Referring again to the FIGURE, preferably four (4) transducers 36 are mounted on the head of each tie bar 18, 20, 22 and 24 (which tie bars are essentially large, elongated bolts). Transducers 36 should be equally spaced and are preferably arranged orthogonally in the four quadrants of each tie bar. In addition, each transducer is preferably positioned between the center and the peripheral area of the tie bar, that is, about midway along the radius in its quadrant in each tie bar. Transducers 36 may be any suitable ultrasonic transducer such as shown, e.g., in U.S. Pat. Nos. 3,759,090, 3,810,385, 3,969,810, 4,413,518 and 4,471,657, all of which are incorporated herein by reference. Preferably, transducers 18, 20, 22 and 24 are 5–10 megahertz piezo electric transducers.

The monitoring system of the present invention further comprises an ultrasonic or extensometer unit 38 for monitoring changes in tie bar length with applied load from the plurality of transducers 36 which send and receive the ultrasonic signals in the tie bars, a microprocessor controller (e.g. computer) 40 for selecting the proper transducer and logging the data, a multiplexer or other suitable electronic interface 42 which switches the transducer signals on command from the controlling microprocessor 40, and a die cast machine operation interrupt 44 (which may be associated with a light and/or siren) which communicates with interface 42. An electrical signal transmission line 46 extends between each ultrasonic transducer 36 and a transducer cable interface unit 48. In turn, transducer cable interface 48 communicates with multiplexer 42.

Extensometer unit 38 is the signal generating, receiving, amplifying and processing unit. Extensometer unit 38 generates the pulses which sequentially trigger each ultrasonic transducer 36 to produce an ultrasonic signal to sequentially traverse the quadrants of tie bars 18, 20, 22 and 24; and unit 38 receives, amplifies and processes the echo signals from the ultrasonic transducer to provide measurements of elongation under load. Examples of ultrasonic transducer units are shown, e.g., in U.S. Pat. Nos. 3,759,090, 3,810,385, 3,969,810, 4,413,518 and 4,471,651 all of which are incorporated herein by reference.

The system operates as follows. The microprocessor controller 40 will communicate with multiplexer 42 to select the transducer 36 to be activated. This activation signal is sent back through multiplexer 42, transducer cable interface 48 and signal line 46 to the selected transducer 36. After the selected transducer has made a measurement, a return signal from the selected transducer is returned through the cable interface 48 and multiplexer 42 to ultrasonic unit 38 for processing. After unit 38 processes the signal to determine transit time, the time signal is transmitted back to multiplexer 42 and into microprocessor 40 for deciphering of the measurement. To be more specific, ultrasonic extensometer 38 is constantly sending ultrasonic pulses to multiplexer 42. Upon selection of a transducer to be pulsed, the next pulse from extensometer 38 is delivered by multiplexer 42 to the selected transducer. The transit time of the ultrasonic pulse in a tie bar quadrant is sensed by extensometer 38. That transit time measurement is then delivered to microprocessor 40 (through multiplexer 42) where it is compared with an initial or zero load transit time measurement for the transducer being operated. The difference between a loaded transit time measurement and the initial or zero load measurement (which is caused by a change in length for that quadrant of the tie bar) is converted to a change in load in that quadrant of the tie bar. After a measurement is received from unit 38 from the selected transducer, the microprocessor control 40 will proceed to select another transducer 36 via multiplexer 42, and the above described process will be repeated for all 16 transducers for one measurement cycle. Upon start-up, the initial (i.e. unloaded) tie bar length is measured by each transducer 36 and stored in microprocessor 40. As the machine 10 loads (e.g. tensions) the tie bolts, computer 40 will ultrasonically monitor the change in length of each tie bar 18, 20, 22 and 24 by selectively reading each transducer 36 to compare readings under load with the unloaded (zero) readings, and thereby obtain load data.

It will be understood from the foregoing that respective cycles of readings of transducers 1–16 are taken in sequence. The first cycle is at the no-load condition to establish a reference base for subsequent readings. Subsequent cycles are taken under loaded conditions to monitor both bending and total load in each tie bar.

The present invention can monitor both uneven tie bar loading in a single tie bar (e.g. bending); as well as uneven tie bar loading between tie bars. In measuring uneven loading or bending in a single tie bar, at least two and preferably four transducers 36 (one in each of the four quadrants) are employed. The microprocessor measures the initial length (with no tensioning or loading) and then monitors the change in length subsequent to loading at each transducer 36 in a single tie bar. Next, the differences between the measured initial lengths and the measured lengths after loading are compared. If bending occurs in that particular tie bar, the variance (standard deviations of the four transducer readings divided by the mean of the four readings) of the four compared readings of the transducers on the one tie bar will exceed an acceptable limit. If the variance exceeds the acceptable limit, microprocessor 40 signals multiplexer 42 to deliver a signal to initiate operation of diecast interrupt 44. The system will then shut down and/or the operator may be alerted by a light, siren, or other signal.

In order to measure uneven tie bar loading between tie bars (in other words, uneven loading on the die), the following steps are effected by microprocessor 40:

(1) the mean of the four individual transducer readings on each tie bar is determined to obtain a load value for each tie bar;

(2) the mean and standard deviation for the four tie bar loads are then determined;

(3) the variance between the four tie bar loads is then determined.

If the variance exceeds a predetermined limit, interrupt 44 is activated to shut down the system.

The above-discussed processes are repeated for each stroke of the machine 10. It will be appreciated that any change in the initial (zero) load length during the continued operation of the machine 10 is due to flash in the die or thermal conditions. The utilization of a plurality of equally spaced transducers (preferably four) on each tie bar permit the monitoring of differential heating across each tie bar as well as changes in the overall initial (zero) load lengths of the four tie bars. The monitoring system of the present invention also permits the tracking of thermally induced loading variances during the operation of the machine.

Still another important feature of the present invention permits the continuous monitoring for cracks in each tie bar. In this case, each transducer 36 is positioned to cover a pre-selected area or of the tie bar so that the entire bar may be monitored. If a crack appears in the area being monitored by a transducer, a drastic change in the ultrasonic reading will occur because the ultrasonic signal will be echoed off the crack. Microprocessor 40 is preferably programmed to shut the system down if the change in ultrasonic reading of a transducer exceeds the previous reading of that transducer by a preselected maximum amount.

It is possible with present ultrasonic transducer technology to take all sixteen transducer readings in a short enough time (a matter of two to eight seconds), so that dynamic and/or thermal loads on the system can be monitored in real time. That time period can also be reduced by using faster or multiple extensometers.

While the system of this invention preferably has four transducers on each tie bar, bending can also be monitored with two transducers on each tie bar. In that case, however, bending will only be measured on the axis between the two transducers, thus reducing the sensitivity of the system. Also, load comparison between the four tie bars can be effected with just one centrally located transducer on each tie bar, but system sensitivity will again be reduced.

It will be appreciated that the various components making up the monitoring system including transducers 36, transducer cable interface 48, multiplexer 42, ultrasonic extensometer 38, microprocessor controller 40 and diecast machine interrupt 44 are all known and commercially available components. Also, the particular type die casing machine 10 shown in the FIGURE (employing a large central bull gear) is shown by way of example only, and in no way limits the present invention for use with that particular die casting machine. Thus, the tie bar monitoring system of the present invention is intended for use with any of the several types of available die casting machines.

While the present invention has been discussed in terms of a die casting machine for casting molten metal, the present invention is also well suited and readily adaptable for use in conjunction with a tie bar monitoring system for other machines that use a tie bar system such as injection molding machines. While a single preferred embodiment has been shown and described, various modifications and substitutions may be made thereto without departing from the spirit and scope of the invention. Accordingly, it is to be understood that the present invention has been described in detail by way of illustration only and not limitation.

What is claimed is:

1. A system for monitoring a plurality of tie bars in a machine comprising:

a plurality of ultrasonic transducer means associated with each tie bar for determining a load parameter on each tie bar;

electronic circuit interface means communicating with each of said transducer means;

ultrasonic measurement means communicating with said interface means; and microprocessor controller means communicating with said interface means for determining at least one load parameter at least one tie bar based on the outputs of a plurality of said ultrasonic transducers.

2. The system of claim 1 including:

machine interrupt means communicating with said interface means to generate an interrupt signal in the event said load parameter exceeds a predetermined limit.

3. The system of claim 1 wherein:

said load parameter is bending load in a tie bar.

4. The system of claim 1 wherein:

said load parameter is the difference in load in a plurality of tie bars.

5. The system of claim 1 wherein:

said electronic circuit interface means comprises multiplexer means.

6. The system of claim 1 wherein:

said at least one transducer communicates with said interface means via transducer cable interface means.

7. The system of claim 1 wherein:

said plurality of spaced ultrasonic transducers are evenly spaced from each other.

8. The system of claim 7 including:

four ultrasonic transducers associated with each of said tie bars.

9. The system of claim 8 wherein each of the tie bars has a substantially circular cross-section defining four quadrants and wherein:

one each of said four ultrasonic tranducers are located in one each of said four quadrants.

10. The system of claim 9 wherein:

each of said four ultrasonic transducers are located at about the midpoint between the center and outer periphery of the circular cross section of the tie bar in each of the respective quadrants.

11. A method of monitoring loading of a plurality of tie bars in a machine which employs a monitoring system comprising ultrasonic transducer means associated with each tie bar for determining a parameter of load on each tie bar, the method including the steps of:

locating a plurality of spaced ultrasonic transducers at selected portions of each tie bar;

obtaining ultrasonic measurements of selected portions of a selected tie bar in the unloaded state;

ultrasonically determining the load on said selected portions of said tie bar subsequent to the tie bar being loaded to define a load parameter measurement of said tie bar; and comparing a plurality of said load parameter measurements to determine the variance between said plurality of load parameter measurements.

12. The method of claim 11 including the further step of:

interrupting the operation of the machine if the variance exceeds a predetermined amount.

13. The method of claim 12 wherein:

said load parameter is bending load in a tie bar.

14. The method of claim 12 wherein:

said load parameter is the different in load on a plurality of tie bars.

15. The method of claim 11 including the step of:

generating an interrupt signal in the event the variance in said load values exceeds a predetermined limit.

16. The method of claim 11 including a microprocessor controller and including the steps of:

storing the ultrasonic measurements in the microprocessor controller.

17. The method of claim 11 including:

determining the variance between the load parameter of each selected portion of said tie bar to determine the imposition of a bending load on said tie bar.

18. The method of claim 17 including:

locating four of said ultrasonic transducers equally spaced apart about one end of each of said tie bars and at about midway between the center and the periphery of each of said tie bars.

19. The method of claim 17 including:

generating an interrupt signal in the event said variance exceeds a predetermined limit.

20. A method of monitoring bending in a tie bar in a machine which has a plurality of tie bars, including the steps of:

locating a plurality of spaced ultrasonic transducers on each tie bar to define selected portions of the tie bar;

ultrasonically measuring the selected portions of the tie bar at a first unloaded time and a second loaded time, respectively, to determine a load parameter for each of said selected portions; and determining the variance between said load parameters to determine the bending load on each said tie bar.

21. The method of claim 20 including the further step of:

interrupting the operation of the machine if the variance exceeds a pre-selected limit.

22. The method of claim 20 including a microprocessor controller and including the step of:

storing the ultrasonically measurements in the microprocessor controller.

23. The method of claim 20 including:

locating four of said ultrasonic transducers orthogonally on one end of each of said tie bars.

24. Apparatus for monitoring loading between the tie bars in a die casting machine, comprising:

a plurality of spaced ultrasonic transducers, a transducer being associated with a selected portion of each tie bar;

means for ultrasonically measuring each selected portion of a selected tie bar in an unloaded state;

means for ultrasonically measuring each selected portion of a selected tie bar in a loaded state to define a load parameter of each selected portion of each selected tie bar;

means for analyzing the load parameters obtained from the selected portion of each tie bar to obtain a load value for each tie bar; and means for determining the variance between load values determined for each of the plurality of tie bars.

25. The apparatus of claim 24 including:

means for interrupting the operation of the die casting machine if the variance exceeds a predetermined limit.

26. The apparatus of claim 24 including a microprocessor controller and including:

means for storing the ultrasonically measured lengths in the microprocessor controller.

27. An apparatus for monitoring bending in a single tie bar in a machine which has a plurality of tie bars comprising:

a plurality of spaced ultrasonic transducers associated with each tie bar for measuring selected portions of the tie bar;

means for ultrasonically measuring selected portions of the tie bar at a first unloaded time and a second loaded time respectively to determine load parameters for each of said selected portions of the tie bars; and means for determining the variance between said load parameters to determine the bending load on said tie bar.

28. The apparatus of claim 27 including:

means for interrupting the operation of the machine if the variance exceeds a preselected limit.

29. The apparatus of claim 27 including a microprocessor controller and including:

means for storing the ultrasonic measurements in the microprocessor controller.

30. The apparatus of claim 27 including:

four ultrasonic transducers equally spaced apart about one end of each of said tie bars.

31. Apparatus for monitoring loading in an elongated load bearing bar system in a machine, said apparatus comprising:

a plurality of mutually spaced apart ultrasonic transducer means arranged in load sensing relation on said elongated load bearing bar system;

means for taking a corresponding plurality of utrasonic load sensing measurements of said bar system through respective ones of said transducer means;

means for determining variance between said load sensing measurements to determine a load parameter on said bar system;

wherein said means for taking a corresponding plurality of ultrasonic load sensing measurements comprises electronic circuit interface means for selectively operating and sampling from said transducer means, and ultrasonic measurement means for providing ultrasonic measurements of sensed load outputs from said transducer means;

wherein said means for determining variance comprises microprocessor controlled means communicating with said transducer means through said electronic circuit interface means and said ultrasonic measurement means, said microprocessor controlled means determining at least one bar system load parameter based on said ultrasonic measurements;

wherein the elongated load bearing bar system comprises at least one elongated bar and said monitoring system comprises a plurality of mutually spaced apart ultrasonic transducer means arranged in load sensing relation on said at least one elongated bar;

and wherein said transducers are arranged in axial strain sensing relation on an end of said at least one elongated bar;

wherein said at least one bar system load parameters is a transverse bending strain determined from a calculated variance between axial strains sensed by respective ones of said transducers;

wherein said loading is dynamic loading calculated on variances between differences in first and second axially strains measured at each of respective ones of said transducers with the bar system and corresponding ones of first static and second dynamic loaded conditions;

and wherein said apparatus comprises at least three transducers arranged in evenly spaced apart relation from one another on said at least one bar.

32. A monitoring system for monitoring loading in an elongated load bearing bar system in a machine, said monitoring system comprising:

a plurality of mutually spaced apart ultrasonic transducer means arranged in load sensing relation on said elongated load bearing bar systems;

microprocessor controlled means communicating with said transducer means through electronic circuit interface means for selectively operating and sampling from said transducers and through ultrasonic measurement means for providing ultrasonic measurements of sensed load outputs from said plurality of transducer means, said microprocessor controlled means determining at least one bar system load parameter based on said ultrasonic measurements; and, and wherein the elongated load bearing bar system comprises an at least one elongated bar and said monitoring system comprises a plurality of mutually spaced apart ultrasonic transducer means arranged in load sensing relation on said at least one elongated bar.

33. The monitoring system according to claim 35 wherein said transducers are arranged in axial strain sensing relation on an end of said at least one elongated bar.

34. The monitoring system according to claim 33 wherein said at least one bar system load parameter is a transverse bending strain determined from a calculated variance between axial strains sensed by respective ones of said transducers.

35. The monitoring system according to claim 34 wherein said loading is static loading.

36. The monitoring system according to claim 32 comprising four transducers arranged in evenly spaced apart relation from one another on said at least one bar.

37. The monitoring system according to claim 36 wherein said at least one bar has a circular cross-section defining four quadrants of equal area, and wherein one of said four transducers is located within a corresponding one of each of said four quadrants.

38. The monitoring system according to claim 37 wherein each of said four transducers is located in each of the corresponding quadrants along the midpoint of respective radii bisecting each said quadrant.

39. The monitoring system according to claim 32 wherein said loading is dynamic loading calculated on variances between differences in first and second axial strains measured at each of respective ones of said transducers with the bar system in corresponding ones of first static and second dynamic loaded conditions.

40. The monitoring system according to claim 39 wherein said electronic interface means comprises multiplexer switching means.

41. The monitoring system according to claim 40 further including machine interrupt means responsive to said variance exceeding a predetermined limit, to generate an interrupt signal.

42. A monitoring system for monitoring loading in an elongated load bearing bar system in a machine, said monitoring system comprising:

a plurality of mutually spaced apart ultrasonic transducer means arranged in load sensing relation on said elongated load bearing bar system;

microprocessor controlled means communicating with said transducer means through electronic circuit interface means for selectively operating and sampling from said transducers and through ultrasonic measurement means for providing ultrasonic measurements of sensed load outputs from said plurality of transducer means, said microprocessor controlled means determining at least one bar system load parameter based on said ultrasonic measurements;

wherein the elongated load bearing system comprises at least two elongated bars and said monitoring system comprises at least one ultrasonic transducer means arranged in load sensing relation on respective ones of said at least two elongated bars;

and wherein said transducers are arranged in axial strain sensing relation on ends of each of said respective bars;

and wherein said at least one bar system load parameter is a transverse bending strain determined from a calculated variance between axial strains sensed by respective ones of said transducers;

and wherein said loading is static loading;

and wherein said system comprises at least three transducers arranged in even spaced apart relation from one another in respect of ones of said bars.

43. The monitoring system according to claim 42 comprising four transducers arranged in evenly spaced apart relation from one another on said at least one bar.

44. The monitoring system according to claim 43 wherein said bars have a circular cross-sections defining four quadrants of equal area, and wherein one of said four transducers is located within a corresponding one of each of said four quadrants.

45. The monitoring system according to claim 44 wherein each of said four transducers is located in each of the corresponding quadrants along the midpoint of respective radii bisecting each said quadrant.

46. A method of monitoring loading in an elongated load bearing bar system of a machine wherein said method comprises the steps of:

obtaining ultrasonic measurements from respective ones of a corresponding plurality of spaced apart transducers; and comparing a plurality of said measurements to determine a load parameter for said elongated load bearing bar system;

wherein said machine includes a monitoring system comprising a plurality of mutually spaced apart ultrasonic transducer means arranged in load sensing relation on said elongated load bearing bar system;

and wherein said monitoring system for monitoring for monitoring loading in said elongated load bearing bar system comprises a plurality of mutually spaced apart ultrasonic transducer means arranged in load sensing relation on said elongated load bearing bar system;

and microprocessor controlled means communicating with said transducer means through electronic circuit interface means selectively operating and sampling from said transducers and through ultrasonic measurement means for providing ultrasonic measurements of sensed load outputs from said plurality of transducer means, said microprocessor controlled means determining at least one bar system load parameter based on said ultrasonic measurements;

and wherein said system comprises an at least one elongated bar and said monitoring system comprises a plurality of mutually spaced apart ultrasonic transducer means arranged in load sensing relation on said at least one elongated bar.

47. The method according to claim 46 wherein said transducers are arranged in axial strain sensing relation on an end of said at least one elongated bar.

48. The method according to claim 47 wherein said at least one bar system load parameter is a transverse bending strain determined from a calculated variance between axial strains sensed by respective ones of said transducers.

49. The method according to claim 46 wherein said load parameter is static loading.

50. The method according to claim 46 wherein said load parameter is dynamic loading calculated on variances between differences in first and second axial strains measured at each of respective ones of said transducers with the bar system in corresponding ones of first static and second dynamic loaded conditions.

51. The method according to claim 46 wherein said elongated load bearing bar system comprises at least two elongated bars and said monitoring system comprises at least one ultrasonic transducer means arranged in load sensing relation on respective ones of said at least two elongated bars.

52. The method according to claim 51 wherein said transducers are arranged in axial strain sensing relation on ends each of said respective bars.

53. The method according to claim 52 wherein said at least one bar system load parameter is a transverse bending strain determined from a calculated variance between axial strains sensed by respective ones of said transducers.

54. A method of monitoring loading in an elongated load bearing bar system of a machine wherein said method comprises the steps of:

obtaining ultrasonic measurements from respective ones of a corresponding plurality of spaced apart ultrasonic transducers; and, comparing a plurality of said measurements to determine a load parameter for said elongated load bearing bar system; initially arranging a plurality of mutually spaced apart ultrasonic transducers in load sensing relation on said elongated load bearing bar systems;

wherein said monitoring system for monitoring loading in said elongated load bearing bar system in said machine comprises a plurality of mutually spaced apart ultrasonic transducer means arranged in load sensing relation on said elongated load bearing bar system; and microprocessor controlled means communicating with said transducer means through electronic circuit interface means for selectively operating and sampling from said transducers and through ultrasonic measurement means for providing ultrasonic measurements of sensed load outputs from said plurality of transducer means, said microprocessor controlled means determining at least one bar system load parameter based on said ultrasonic measurements;

wherein the elongated load bearing bar system comprises an at least one elongated bar and said monitoring system comprises a plurality of mutually spaced apart ultrasonic transducer means arranged in load sensing relation on at least one bar.

* * * * *